US007886388B2

(12) United States Patent
Warren et al.

(10) Patent No.: US 7,886,388 B2
(45) Date of Patent: Feb. 15, 2011

(54) MATTRESS ADAPTED FOR SUPPORTING HEAVY WEIGHT PERSONS

(75) Inventors: Stephen C. Warren, Philadelphia, PA (US); Jose D. Contreras, West Covina, CA (US); Kerry Lynn McCabe, Chester, PA (US); Beat B. Niederoest, Medford Lakes, NJ (US)

(73) Assignee: Foamex Innovations Operating Company, Media, PA (US)

( * ) Notice: Subject to any disclaimer, the term of this patent is extended or adjusted under 35 U.S.C. 154(b) by 0 days.

(21) Appl. No.: 12/429,778

(22) Filed: Apr. 24, 2009

(65) Prior Publication Data

US 2010/0269262 A1 Oct. 28, 2010

(51) Int. Cl.
*A47C 17/00* (2006.01)

(52) U.S. Cl. ..... 5/740; 5/730; 5/655.9

(58) Field of Classification Search ..... 5/740, 5/730, 729, 665.9, 953
See application file for complete search history.

(56) References Cited

U.S. PATENT DOCUMENTS

| | | | |
|---|---|---|---|
| 3,828,378 | A | 8/1974 | Flam |
| 3,885,257 | A | 5/1975 | Rogers |
| 4,073,020 | A | 2/1978 | Stalter et al. |
| 4,148,855 | A | 4/1979 | Stalter et al. |
| 4,265,484 | A | 5/1981 | Stalter |
| D263,104 | S | 2/1982 | Stalter, Sr. |
| 4,335,476 | A | 6/1982 | Watkin |
| 4,706,313 | A | 11/1987 | Murphy |
| 4,757,564 | A | 7/1988 | Goodale |
| 4,879,776 | A | 11/1989 | Farley |
| 5,010,609 | A | 4/1991 | Farley |
| 5,038,433 | A | 8/1991 | Farley |
| 5,077,849 | A | 1/1992 | Farley |
| 5,111,542 | A | 5/1992 | Farley |
| 5,127,119 | A | 7/1992 | Rogers |
| 5,178,811 | A | 1/1993 | Farley |
| 5,201,780 | A | 4/1993 | Dinsmoor, III et al. |
| 5,231,717 | A | 8/1993 | Scott et al. |
| 5,255,404 | A | 10/1993 | Dinsmoor, III et al. |
| 5,303,436 | A | 4/1994 | Dinsmoor, III et al. |
| 5,334,646 | A | 8/1994 | Chen |
| D352,858 | S | 11/1994 | Farley |
| 5,430,901 | A | 7/1995 | Farley |
| 5,511,260 | A | 4/1996 | Dinsmoor, III et al. |

(Continued)

FOREIGN PATENT DOCUMENTS

| | | |
|---|---|---|
| EP | 0634124 | 1/1995 |

(Continued)

*Primary Examiner*—Robert G Santos
*Assistant Examiner*—Brittany M Wilson
(74) *Attorney, Agent, or Firm*—Connolly Bove Lodge & Hutz LLP

(57) ABSTRACT

A mattress constructed with multiple foam layers joined together provides reclining support with pressure redistribution for heavy weight persons, particularly those weighing over 350 pounds. The mattress includes: a core layer having a substantially planar top surface and at least two spaced apart regions in a bottom surface from which foam material has been extracted to leave cavities separated by an interconnected network of foam walls, a top layer of viscoelastic foam with an air permeability above 60 $ft^3/ft^2/min$, and a bottom layer of stiffer supporting foam. The open cavities of the core layer are directed away from the body supporting top surface of the mattress.

18 Claims, 5 Drawing Sheets

U.S. PATENT DOCUMENTS

| | | | | |
|---|---|---|---|---|
| 5,655,241 | A | 8/1997 | Higgins et al. | |
| D383,349 | S | 9/1997 | Steelman et al. | |
| 5,749,111 | A | 5/1998 | Pearce | |
| 5,794,289 | A | 8/1998 | Wortman et al. | |
| 5,879,780 | A | 3/1999 | Kindinger et al. | |
| 5,974,609 | A | 11/1999 | Nunez et al. | |
| 6,041,459 | A | 3/2000 | Nunez et al. | |
| 6,237,173 | B1 * | 5/2001 | Schlichter et al. | 5/740 |
| 6,701,557 | B2 | 3/2004 | Barman | |
| 6,807,698 | B2 | 10/2004 | Torbet et al. | |
| 7,036,172 | B2 | 5/2006 | Torbet et al. | |
| 7,076,822 | B2 | 7/2006 | Pearce | |
| 2002/0046800 | A1 | 4/2002 | Barker et al. | |
| 2005/0172414 | A1 | 8/2005 | Lewis et al. | |
| 2006/0288491 | A1 * | 12/2006 | Mikkelsen et al. | 5/740 |
| 2008/0028532 | A1 | 2/2008 | Rogers | |

FOREIGN PATENT DOCUMENTS

| | | |
|---|---|---|
| EP | 0870447 | 10/1998 |
| FR | 2473291 | 7/1981 |
| GB | 1445561 | 8/1976 |
| JP | 2005118097 | 5/2005 |
| JP | 2008258354 | 10/2008 |
| NL | 1000224 | 10/1996 |
| WO | WO-2007/000581 | 1/2007 |
| WO | WO-2007/053035 | 5/2007 |
| WO | WO-2008086861 | 7/2008 |

* cited by examiner

MATTRESS ADAPTED FOR SUPPORTING HEAVY WEIGHT PERSONS

FIELD OF THE INVENTION

The present invention relates to bedding mattresses and medical mattresses that redistribute pressure and reduce incidence of bed sore formation, which we believe will support persons weighing up to 350 pounds and over.

BACKGROUND

Prolonged contact between body parts and a mattress surface tends to put pressure onto the reclining person's skin. The pressure tends to be greatest on the body's bony protrusions (such as sacrum, hips and heels) where body tissues compress against the mattress surface. Higher compression tends to restrict capillary blood flow, called "ischemic pressure", which causes discomfort. The ischemic pressure threshold normally is considered to be approximately 40 mmHg. Above this pressure, prolonged capillary blood flow restriction may cause red spots or sores to form on the skin (i.e., "stage I pressure ulcers"), which are precursors to more severe tissue damage (i.e., "stage IV pressure ulcers" or "bed sores"). The preferred pressure against the skin of a person in bed remains generally below the ischemic threshold (e.g., below 40 mmHg, preferably below 30 mmHg).

Pressure build up from contact with the fabric ticking or outer fabric cover of a mattress may be more acute for heavy weight people who tend to sink farther into a mattress and stretch the ticking or cover to a greater extent. This is called "hammocking", which is to be avoided. See U.S. Pat. Nos. 5,655,241 (Higgins) and 5,475,881 (Higgins).

Poor body alignment on a mattress also leads to body discomfort, leading to frequent body movement or adjustment during sleeping and a poor night's sleep. Particular challenges are faced when a reclining person weighs 350 pounds or more. Higher weight persons tend to sink farther into and depress a mattress more than lower weight persons. Higher weight persons may cause the mattress to sag excessively or bottom out, particularly at the sacrum supporting region. A sagging mattress also allows the person's waist to drop relative to the rib cage and hips, and causes stress to muscles, tendons and ligaments. Such stress may lead to joint pain, particularly lumbar and back pain.

An ideal mattress has a resiliency over the length of the body reclining thereon to support the person in spinal alignment and without allowing any body part to bottom out. A preferred side-lying spinal alignment of a person on a mattress maintains the spine in a generally straight line and on the same center line as the legs and head. An ideal mattress further has a low surface body pressure over all or most parts of the body in contact with the mattress. This objective, however, competes with the objective of providing satisfactory support for a heavy weight person.

Hospitals and healthcare providers continue to seek lower cost alternatives for mattresses that may be used for patient beds. Mattress constructions with springs and heavy supporting structures that may be appropriate for home use are not appropriate for hospitals and clinics. Patient-supporting mattresses generally should be lighter weight and portable so that they can be moved with the patient. In some cases, such mattresses are disposable. These objectives, however, compete with the objective of providing satisfactory support for a heavy weight person.

Numerous mattress constructions have been proposed to vary the body support without incorporating traditional springs. For example, U.S. Pat. No. 7,036,172 (Torbet, et al.) discloses several mattress constructions having multiple foam layers of different densities positioned in different sections to vary the supporting characteristic in each section. In some embodiments, Torbet, et al. has a single foam layer in the shoulder and hip supporting portion, and punches holes of varying depths into the foam surface to vary the support characteristic.

U.S. Pat. No. 5,749,111 (Pearce) shows seat cushions and mattresses with a base material of a gelatinous elastomer that is molded to form a plurality of hollow columns. The hollow columns buckle under applied loads. Open or closed cell foam can be held within the hollow columns to increase the firmness of the cushions. U.S. Pat. No. 7,076,822 (Pearce 2) includes a layer with hollow columns formed therethrough in a mattress construction.

In addition to alternative mattress constructions, mattress pads or overlays to dispose over a surface of an existing hospital mattress to reduce pressure on a reclining patient are known. U.S. Pat. Nos. 5,201,780; 5,255,404; and 5,303,436 to Dinsmoor, III, et al. show anti-decubing mattress pads that include foam support columns that are hollowed out to varying degrees to form conical cavities of different depths to vary the support or spring performance of the foam support columns. Such pads or overlays add additional cost to patient care.

There are an increasing number of people weighing 350 pounds or more, and in some cases up to 1000 pounds. The bedding industry, and particularly the medical mattress industry, continues to seek alternative mattress constructions that can adequately support such heavy weight persons, yet still meet the competing objectives of low cost, portability, satisfactory body support and low surface body pressure.

SUMMARY OF THE INVENTION

A bedding mattress or medical mattress suitable for home or hospital or use has a multi-layer construction with a first foam layer providing a body-supporting surface and having a plurality of projections with substantially flat tops separated by gaps there between wherein the substantially flat tops define a top surface of said first foam layer. A second foam layer is oriented with its top surface in contact with the bottom surface of the first foam layer. The second foam layer defines at least two regions of the bottom surface from which foam material has been extracted to define multiple open cavities separated by inter-connected foam walls. A third foam layer is oriented with its top surface in contact with the bottom surface of the second foam layer. Preferably, the first foam layer is joined to the second foam layer and the second foam layer is joined to the third foam layer. The second foam layer thus forms a core layer. All of the layers may be surrounded or encased with a ticking material or casing to form the mattress construction.

In this first embodiment, the first foam layer is formed of a viscoelastic polyurethane foam having a density in the range of 1.5 pcf to 10 pcf, the second foam layer is formed of a polyurethane foam having a density in the range of 1.0 pcf to 6.0 pcf, and the third foam layer is formed of a polyurethane foam having a density in the range of 1.0 pcf to 6.0 pcf. Preferably, the viscoelastic foam of the first layer has an air permeability above 60 $ft^2/ft^3/min$. Most preferably, the viscoelastic foam of the first layer has an air permeability above 100 $ft^2/ft^3/min$.

The second foam layer defines a thickness and the multiple open cavities have a depth of from about one-twelfth to six-sevenths of the thickness of the second foam layer. Optimally, the second foam layer defines at least four regions in the bottom surface from which foam material has been extracted to define multiple open cavities separated by inter-connected foam walls, and the multiple open cavities define a void volume that comprises from 5% to 50% of the volume of the second foam layer. Optimally, a substantial portion of the multiple open cavities each define in cross-section a geometric shape such as circular, oval, hexagonal, octagonal, square, triangular, or diamond. It is possible that different geometric shapes may be formed in one region or in separate regions when foam is extracted from the second layer.

DESCRIPTION OF THE DRAWINGS

The advantages of this invention will be more readily apparent from the following description of the drawings in which.

DESCRIPTION OF THE PREFERRED EMBODIMENTS

Figure 1:
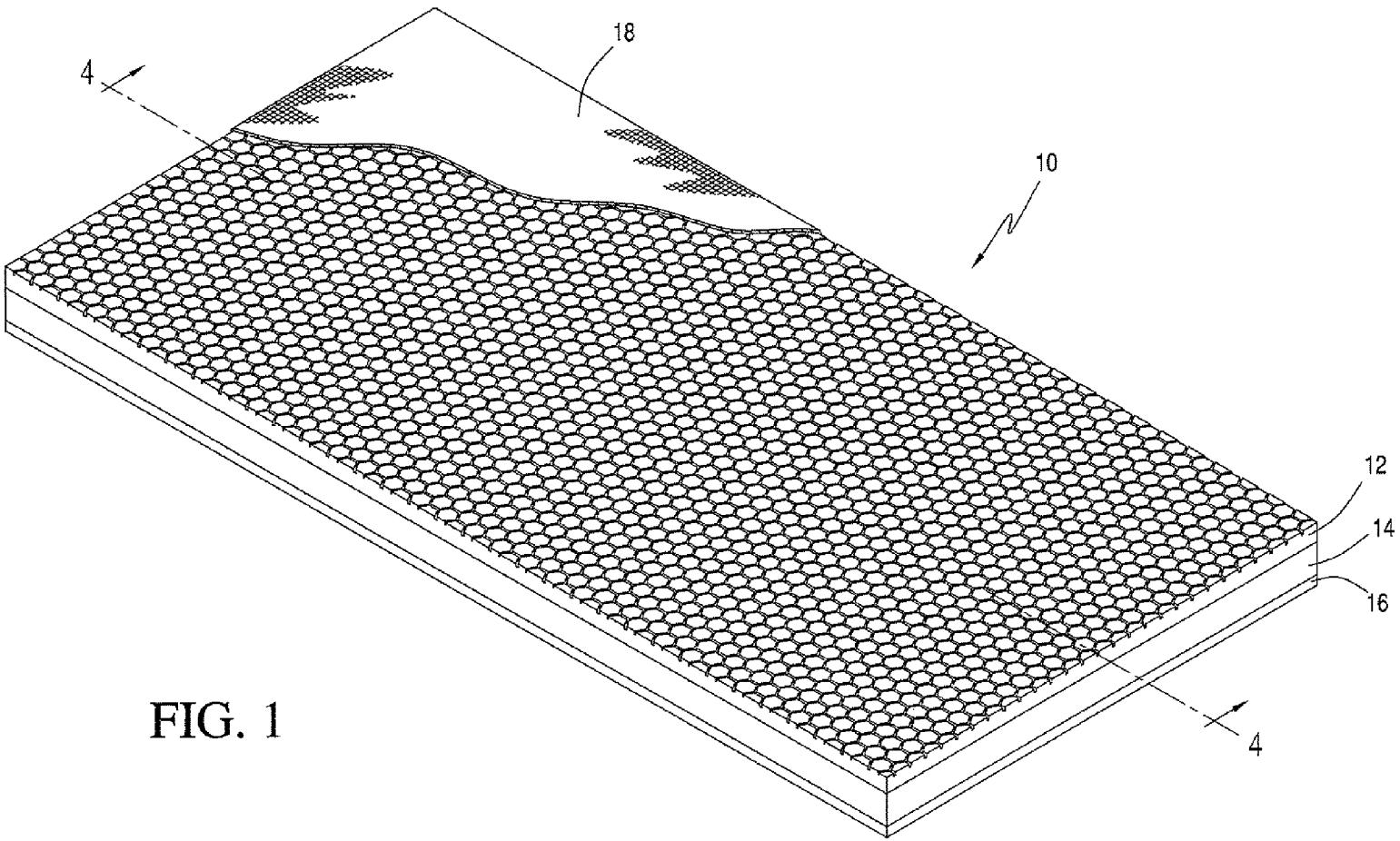
FIG. 1 is a top perspective view of a mattress according to the invention.

Bedding mattresses and the components used to make such mattresses may be characterized by several physical properties, including density, stiffness, tensile strength, indentation force deflection (IFD), hysteresis, and pressure reduction, among others. Foams, such as polyurethane foams, may be further characterized by air permeability.

Density is the mass per unit volume.

Tensile strength is a measure of the force required to rupture a material when it is stretched. Changes in length after applying a tensile force are measured as elongation percent. Tensile strength and elongation are determined in accordance with the procedures set out in ASTM D 3574. The foam is die cut to form a test specimen with a length of 5.5", width of 1" and a narrowed central portion with a width of about 0.5". The specimen is pulled at both ends until rupture. The tensile strength is calculated by dividing the breaking force by the original cross-sectional area of the central portion of the specimen. Tensile strength is reported in pounds per square inch. The elongation is determined in percent by dividing the difference of the specimen length at rupture and the original specimen length by the original specimen length.

Stiffness is the resistance against pressure. Indentation Force Deflection (IFD) is a measure of the stiffness of the foam and is reported in pounds of force. It represents the force exerted when the foam is compressed by 25% with a compression platen. The procedure is set out in ASTM D 3574. In this case, for IFD at 25%, foam is compressed by 25% of its original height and the force is reported after one minute. The foam samples are cut to a size of 15"×15"×4" prior to testing.

Tear strength is determined using the ASTM D 3574 test procedure. A 6" long, 1" wide and 1" thick foam specimen has a slit formed in one end. The specimen is pulled apart at the slit until it ruptures or at least 50 mm in length is torn. The tear strength is calculated from the maximum force registered on the testing machine divided by the specimen thickness. Tear strength is reported in pounds per linear inch.

Resilience or elasticity is measured using the ASTM D 3574 standard. Resilience is measured by the ball rebound test, where a steel ball is dropped from a height onto a foam and the rebound distance of the ball is measured as a percentage of a predetermined height.

Compression modulus or sag factor is a compression measurement defined in the ASTM D 3574 standard. The sag factor is defined as the ratio of indentation force deflection at 65% to the indentation force deflection at 25% ($IFD_{65\%}$ to $IFD_{25\%}$). The sag factor is intended to correlate with a person's perception as to whether a mattress has a combined initial softness and sufficient body support.

Hysteresis loss is measured using the load deformation curve of the load surface. The hysteresis loss curve is determined by loading and de-loading a material. The hysteresis, which is a strong function of the deformation rate, provides a measure of the energy absorbing nature of the material. Foams that are more energy absorbing will have higher hysteresis loss percentages. A method for measuring hysteresis loss is outlined in ASTM D 3574.

Air permeability for foams is determined in cubic feet per square foot per minute for each foam sample using a Frazier Differential Pressure Air Permeability Pressure machine in accordance with ASTM 737. Higher Frazier permeability values translate to less resistance to air flow.

Polyurethane foams are widely used in the construction of bedding, particularly mattresses and mattress toppers or pads. Bedding constructions that include viscoelastic foams have become very popular not only for medical and orthopedic applications, but also for home use. Viscoelastic foams exhibit slower recovery when a compression force is released than other resilient polyurethane foams. For example, after being released from compression, a resilient polyurethane foam at room temperature and atmospheric conditions generally recovers to its full uncompressed height or thickness in one second or less. By contrast, a viscoelastic foam of the same density and thickness, and at the same room temperature condition, will take significantly longer to recover, even from two to sixty seconds. The recovery time of viscoelastic foams is sensitive to temperature changes within a range close to standard room temperature. Slow recovery foams also exhibit ball rebound values of generally less than about 20% as compared to about 40% or more for other foams.

A precise definition of viscoelastic foam is derived by a dynamic mechanical analysis to measure the glass transition temperature (Tg) of the foam. Nonviscoelastic resilient polyurethane foams, based on a 3000 molecular weight polyether triol, generally have glass transition temperatures below −30 C, and possibly even below −50 C. By contrast, viscoelastic polyurethane foams have glass transition temperatures above −20 C. If the foam has a glass transition temperature above 0 C, or closer to room temperature (e.g. room temperature=about +20 C), the foam will manifest more viscoelastic character (i.e., slower recovery from compression) if all other parameters are held constant.

Figure 2:
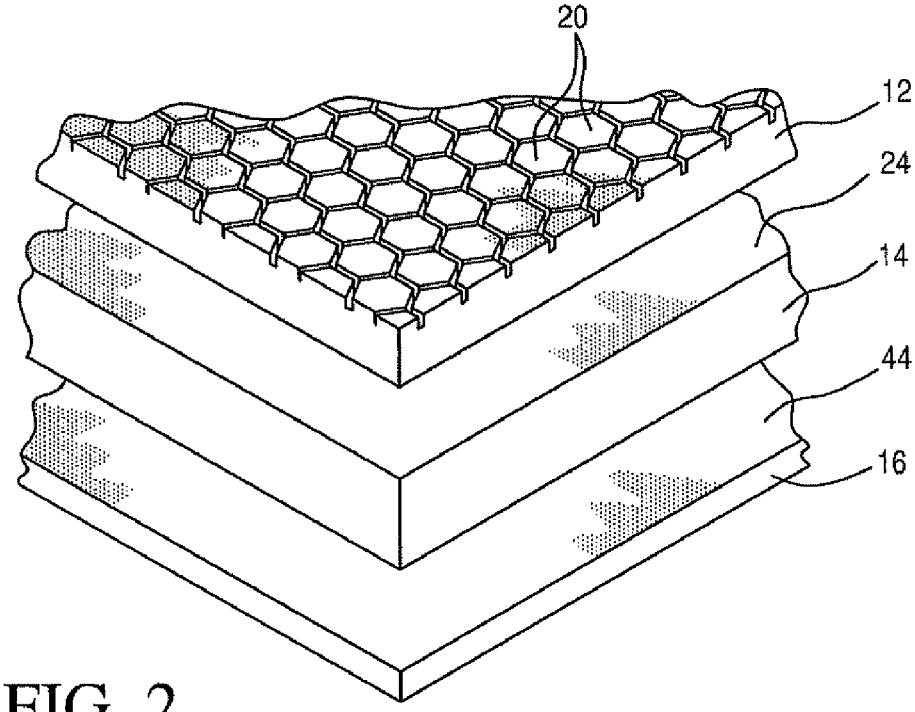
FIG. 2 is a partial exploded top perspective view of the mattress of FIG. 1.
Figure 3:
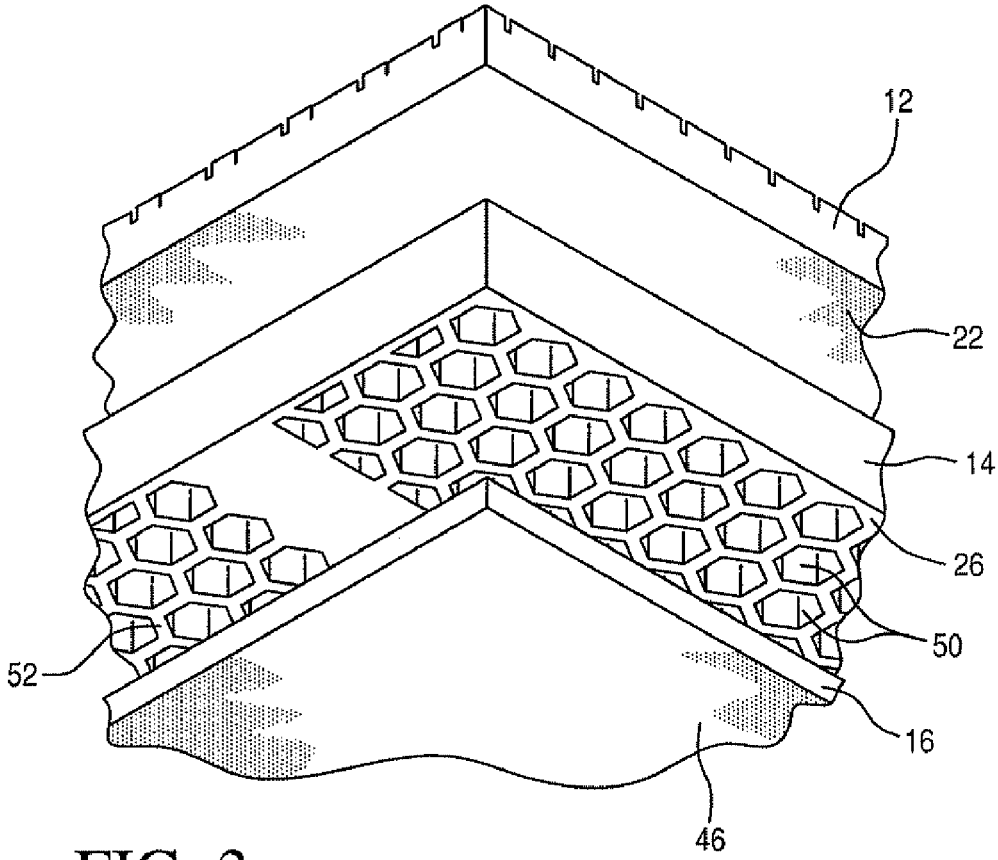
FIG. 3 is a partial exploded bottom perspective view of the mattress of FIG. 1.

Referring now to FIGS. 1-3, perspective views of an embodiment of a mattress 10 is shown. The mattress 10 has a top layer 12, a core or middle layer 14, and a bottom layer 16. The three layers 12, 14, 16 form in combination the sleeping mattress 10. The three layers 12, 14, 16 may be enveloped with a fabric casing or ticking 18 to form the sleeping mattress 10. Representative fabric casing or ticking materials include: bilaminate nylon knit/polyurethane film, nylon taffeta, polyurethane film, bilaminate polyurethane film, polyester, and others.

The top layer 12 of this first embodiment comprises a viscoelastic foam. Representative viscoelastic foams include foams with glass transition temperatures above −20 C and with ball rebound values of less than approximately 20%. The viscoelastic foam of the top layer 12 may have a density in the range of 1.5 pcf to 10.0 pcf, more particularly 3.0 pcf to 6.0 pcf.

Viscoelastic or slow-recovery foams frequently have lower air permeabilities, which leads to increased heat build-up when such foams are used in mattress constructions. Higher skin temperatures may accelerate pressure ulcer formation. In one embodiment, the viscoelastic foam used for the top layer 12 is an open cell foam with an air permeability of at least about 60 $ft^3/ft^2$/min, preferably at least about 100 $ft^3/ft^2$/min. Foams with such air permeability help to maintain a reclining person's skin temperature closer to normal body temperatures, e.g., 96-100° F.

The top surface of the top layer 12 preferably has one or more regions with surface modification forming upstanding peaks or projections 20 separated by troughs. The top layer 12 may be provided with a desired thickness. Particularly, if the top layer 12 has a thickness of about 2 inches, the peaks or projections 20 preferably have substantially flat top surfaces and have a height in the range of about 0.125 to about 1 inch. The peaks or projections 20 are compressible individually thus exhibiting individual spring-like action.

As shown in FIGS. 1-3, the peaks or projections 20 have hexagonal-shaped top surfaces. Other shapes may be formed as the top surfaces as desired. Representative shapes include geometric shapes such as but not limited to, circular, oval, triangular, square, diamond, pentagonal, hexagonal, and octagonal.

The bottom surface 22 of the top layer 12 is generally flat or substantially planar. The bottom surface 22 may be joined, such as with adhesive lamination, to the adjoining surface of the core or middle layer 14.

The core layer or middle layer 14 of this first embodiment comprises a foam, more particularly a polyurethane foam. Representative polyurethane foams include conventional polyether foams as well as high resiliency polyether foams. High resiliency polyether foams generally have sag factors at least approximately 10% higher than conventional polyether foams. The polyurethane foam of the core layer 14 may have a density in the range of 1.0 pcf to 6.0 pcf, more particularly 1.5 pcf to 3.0 pcf.

The top surface 24 of the core layer 14 is generally flat or substantially planar. The top surface 24 may be joined, such as with adhesive lamination, to the adjoining surface of the top layer 12.

The bottom surface 26 of the core layer 14 is generally flat or substantially planar. As shown in FIG. 3, the bottom surface 26 has regions from which foam material has been extracted to form multiple cavities 50 separated by upstanding sidewalls 52. The foam material has not been cut away at the upstanding sidewalls 52. The cavities 50 extend to a depth within the thickness of the core layer 14 and terminate in cavity bases 54. The core layer 14 may be provided with a desired thickness. Particularly, if the core layer 14 has a thickness of about 3 inches, the cavities 50 extend to depths of from about 0.25 to 2.6 inches. The cavities in a region may have the same or different depths. Alternatively, the cavities in one region may have a depth different from the cavities of a second region. For simplicity and cost saving, it may be preferred to extract foam to the same cavity depth in each region.

Figure 4:
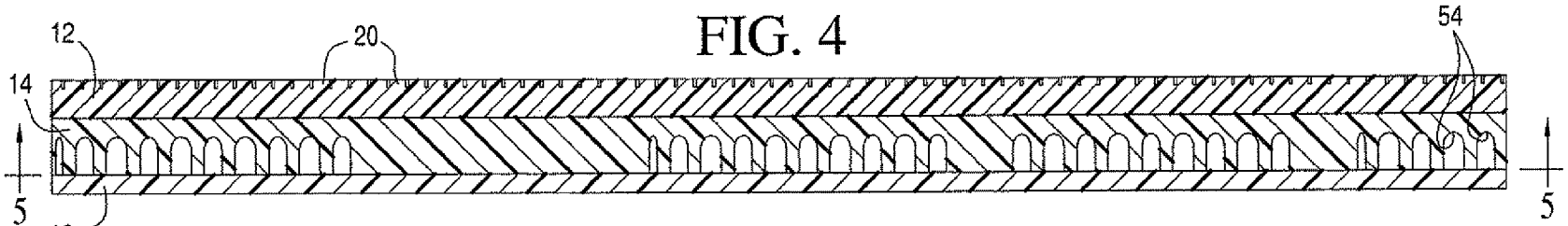
FIG. 4 is a side elevational view of the mattress of FIG. 1.

As illustrated in FIGS. 3 and 4, the open cavities 50 define hexagons in cross section, and the upstanding sidewalls 52 form a honey-comb grid or network. Other cavity shapes may be formed as desired. Representative shapes include geometric shapes, such as, but not limited to, circular, oval, triangular, square, diamond, pentagonal, hexagonal, and octagonal.

One cutting method that may be employed to extract foam from the surface of the core layer 14 is a rotary cutting method such as that set out in U.S. Pat. No. 5,534,208, the disclosure of which is incorporated herein by reference.

Figure 5:
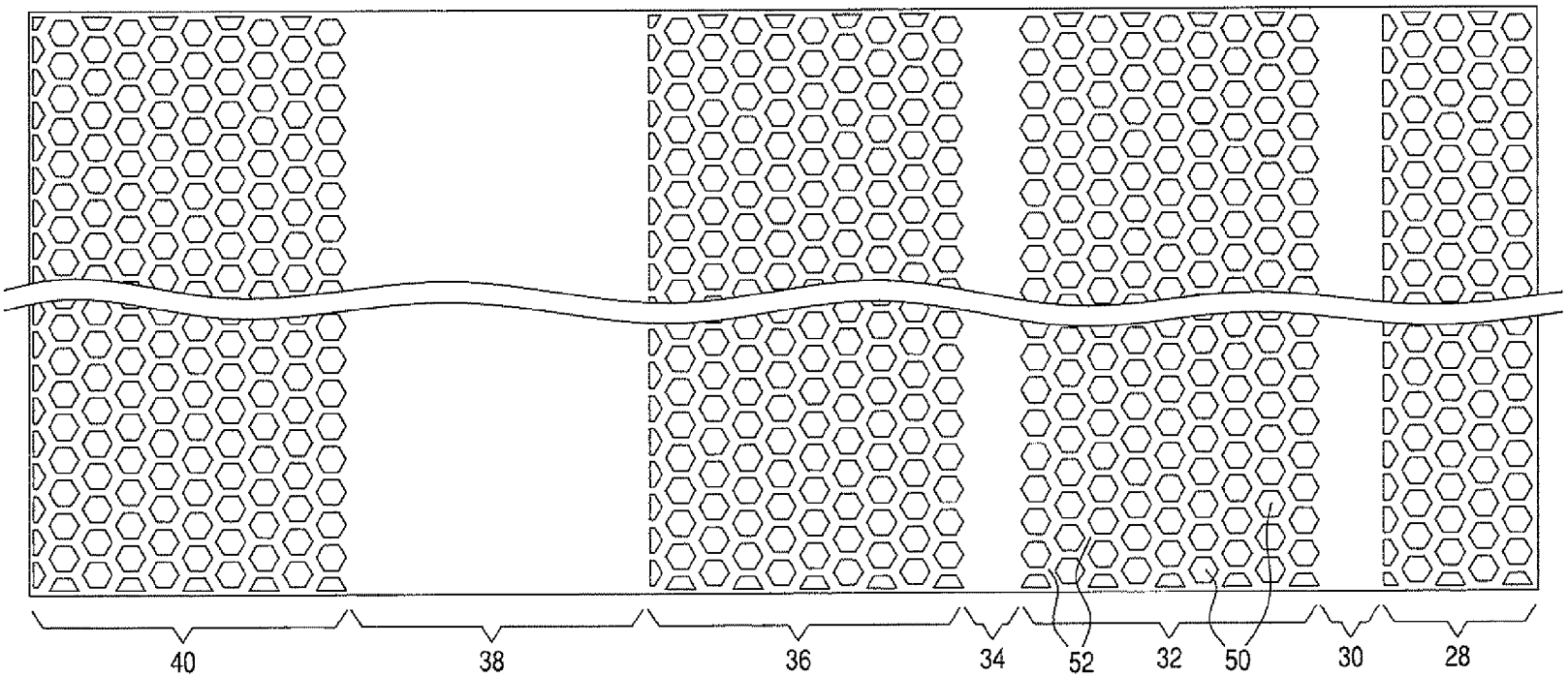
FIG. 5 is a bottom view of the core layer of the mattress of FIG. 1.

FIGS. 4 and 5 show in particular that the bottom surface 26 of the core layer 14 in this embodiment defines, four regions from which foam material has been extracted, separated by three regions where foam material remains in tact. A first region 28 is disposed at one end of the core layer 14, and rests below a head-supporting region of the mattress 10. A second region 30 is disposed adjacent to the first region 28 and rests below a neck-supporting region of the mattress 10. A third region 32 is disposed adjacent to the second region 30 and rests below a shoulder- and torso-supporting region of the mattress 10. A fourth region 34 is disposed adjacent to the third region 32 and rests below a waist-supporting region of the mattress 10. A fifth region 36 is disposed adjacent to the fourth region 34 and rests below a hip- and sacrum-supporting region of the mattress 10. A sixth region 38 is disposed adjacent to the fifth region 36 and rests below a leg-supporting region of the mattress 10. A seventh region 40 is disposed at the opposite end from the first region 28, and is adjacent to the sixth region 38, and rests below a foot/heel-supporting region of the mattress 10. The mattress 10 of this embodiment has seven zones.

By forming cavities 50 in regions 28, 32, 36, and 40, such regions have lower support characteristics than present in the regions 30, 34, 38 from which foam has not been extracted. As such, heavier body portions of the person reclining on the mattress 10 will sink further into the mattress at the mattress regions corresponding to core layer regions 28, 32, 36 and 40. In other words, the head, shoulders, sacrum and feet of the person reclining on the mattress 10 will sink further into the mattress. This effect redistributes weight/pressure across the mattress surface to reduce ischemic pressure on the person's bony protuberances, but increases the weight/pressure supported by other regions of the mattress where ischemic pressure normally remains well below the ischemic pressure threshold.

We have found that the combination of top layer 12 of viscoelastic foam and core layer 14 of foam with regions having foam extracted from a bottom surface to form cavities 50 enhances pressure redistribution for a reclining adult. The core layer 14 is directed with the open cavities 50 directed away from the body-supporting surface of the mattress 10. In this orientation, the core layer 14 helps to redistribute pressure by permitting heavy or bony body parts to sink into the mattress 10 without bottoming out. By having the cavities 50 pointing downward in core layer 14, the bottom surface 26 compresses against the top surface 44 of the bottom layer 16 and forms a spring effect that helps support heavier body parts.

Optimally, the cavities 50 have bases 54 with concavely curved surfaces. The concavely curved surfaces of the core layer 14 are directed away from the body-supporting surface of the mattress 10 as shown in FIG. 4. This orientation offers higher initial support, and resists compression to a greater degree than if the core layer 14 were positioned with the cavities 50 directed toward the body-supporting surface of the mattress 10.

In first region 28 a range of 5% to 70% of the foam material volume has been extracted, more particularly 40% to 50%, to form the cavities 50. In third region 32 a range of 5% to 70% of the foam material volume has been extracted, more particularly 40% to 50%, to form the cavities 50. In fifth region 36 a range of 5% to 70% of the foam material volume has been extracted, more particularly 40% to 50%, to form the cavities 50. In seventh region 40 a range of 5% to 70% of the foam material volume has been extracted, more particularly 40% to 50%, to form the cavities 50. The core layer 14 altogether has a void volume representing from about 5% to 50% of the core layer 14 material.

The bottom layer 16 of this first embodiment comprises a polyurethane foam that includes either a conventional polyether foam or a high resiliency polyether foam having a density in the range of 1.0 pcf to 6.0 pcf, more particularly 1.5 pcf to 3.0 pcf. As shown in FIGS. 2 and 3, the bottom layer 16 has a generally flat or substantially planar top surface 44 that is joined, such as with adhesive lamination, to the bottom surface 26 of the core layer 14. The bottom layer 16 also has a generally flat or substantially planar bottom surface 46.

Figure 6:
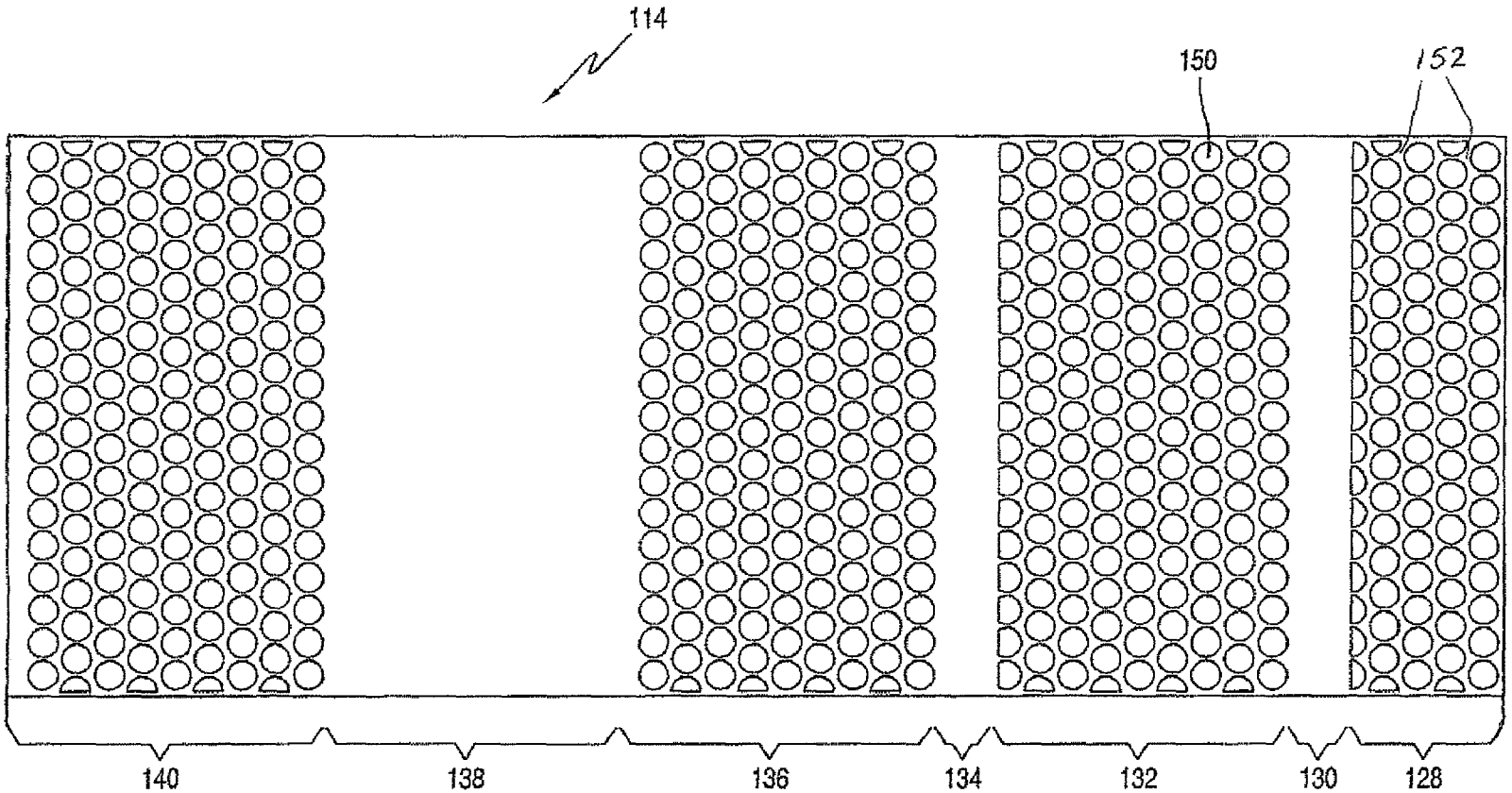
FIG. 6 is a bottom view of a core layer of a first alternate embodiment of a mattress according to the invention.

FIG. 6 shows a bottom surface 126 of an alternative core layer 114 of a mattress construction according to the invention. Comparable to the core layer 14 of FIG. 5, the alternative core layer 114 shown in FIG. 6 has cavities 150 formed in four regions 128, 132, 136 and 140, leaving three regions 130, 134, and 138 from which foam material has not been extracted. The cavities 150 in the core layer 114 of FIG. 6 have circular or generally circular shapes in cross section, rather than the hexagonal cavities 50 of the core layer in FIG. 5. Cavity 150 diameter and depth may vary between cut regions, or between cavities within a region. The base of each cavity generally may be concavely curved, and the core layer 114 is positioned with the open cavities 150 oriented away from the body supporting surface of the mattress (same orientation as in FIG. 4). Where the upstanding sidewalls 152 between cavities 150 are thicker, the region will have a greater resistance to compression than where the upstanding sidewalls 152 between cavities 150 are thinner. The core layer 114 permits heavier body portions to sink more deeply into the mattress construction than other body portions to redistribute pressure over the mattress surface.

In first region 128 of core layer 114 a range of 5% to 65% of the foam material volume has been extracted, more particularly 35% to 45%, to form the cavities 150. In third region 132 a range of 5% to 65% of the foam material volume has been extracted, more particularly 35% to 45%, to form the cavities 150. In fifth region 136 a range of 5% to 65% of the foam material volume has been extracted, more particularly 35% to 45%, to form the cavities 150. In seventh region 140 a range of 5% to 65% of the foam material volume has been extracted, more particularly 35% to 45%, to form the cavities 150. The core layer 114 altogether has a void volume representing from about 5% to 45% of the core layer 114 material.

The mattress 10 or 110 is suitable to support heavy-weight persons without springs, wires or other added weight bearing or weight distributing structures.

Figure 7:
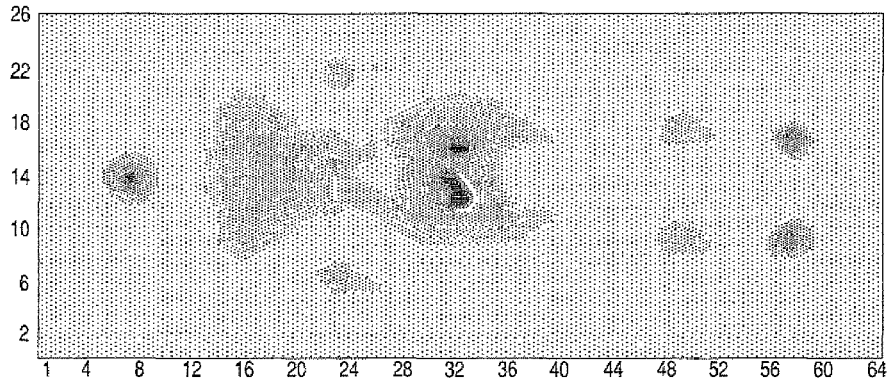
FIG. 7 is a pressure plot showing pressure distribution for an adult female reclining on a typical latex foam medical mattress.
Figure 8:
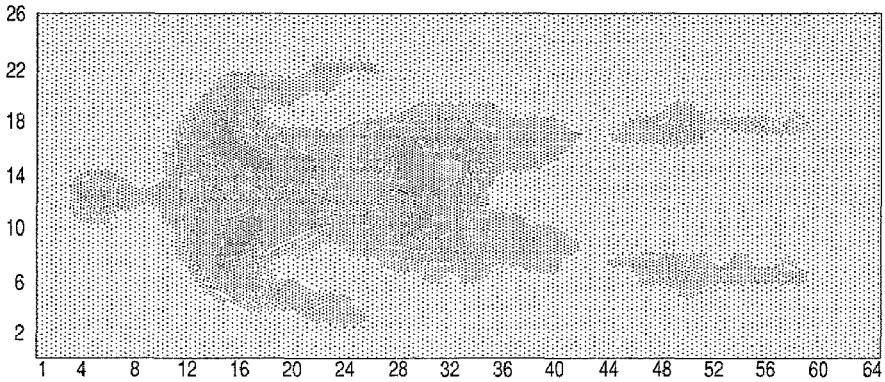
FIG. 8 is a pressure plot showing pressure distribution for an adult female reclining on the mattress of FIG. 1.

Referring to FIGS. 7 and 8, pressure distribution maps were generated using an XSensor PX100: 26.64.01 pressure mapping system comparing the surface pressure on the surface of a commercial medical mattress made from a latex foam (FIG. 7), with the surface pressure on the surface of a mattress 10 according to the invention (FIG. 8). An adult female with a height 5'3" and weighing 120 pounds was pressure mapped in the supine position using an XSensor PX100: 26.64.01 pressure mapping system. The subject was mapped for 3 minutes at a rate of 600 frames per minute. The average pressure for all frames was added and divided by the total number of frames. The peak pressure for all frames was added and divided by the total number of frames. The area for all frames was added and divided by the total number of frames. The average pressure, peak pressure, and area were reported.

Comparing FIG. 8 to FIG. 7, one can observe that higher pressure points were formed under the head, shoulders, hips and heels with the commercial medical mattress. FIG. 7 shows darker regions where pressure was highest, and above the ischemic pressure threshold. The mattress 10 according to the invention (FIG. 8) redistributed pressure across a greater extent of the body, thus reducing the maximum pressure of the pressure points formed under the head, shoulders, hips and heels to levels below the ischemic pressure threshold.

Table 1 compares the performance of exemplary mattresses (Examples 1 and 2) according to embodiments of the invention with commercial medical mattresses (Samples A, B, C, D and E). In Table 1, Example 1 was a three layer foam mattress 10 with the first layer 12 composed of a viscoelastic polyurethane foam with a density of 5 pcf and a thickness of about 2 inches, the core layer 14 composed of a conventional polyether polyurethane foam with a density of 1.65 pcf and thickness of about 3 inches, and the bottom layer 16 composed of a conventional polyether polyurethane foam with a density of 1.8 pcf and thickness of about 1 inch. The top surface of the top layer 12 preferably has surface modifications forming upstanding peaks or projections 20 separated by troughs. The projections 20 are hexagonal in shape with substantially flat top surfaces and have a height in the range of about 0.375 inches. The core layer 14 had a thickness of 3 inches with cavity depth of 2 inches. The cavities 50 had hexagonal cross-sectional shapes, with each side of the hexagon having a length of approximately 1 inch. Four of the zones in the seven total zones had cavities in the core layer, with the cavity depth approximately equal in all four zones.

In Table 1, Example 2 was a three layer foam mattress with the first layer composed of a viscoelastic polyurethane foam with a density of 4 pcf, and thickness of about 2 inches, an alternative core layer 114 composed of a conventional polyether polyurethane foam with a density of 1.75 pcf and thickness of about 2 inches and the bottom layer composed of a conventional polyether polyurethane foam with a density of 1.8 pcf and thickness of about 2 inches. The top surface of the top layer preferably has surface modifications forming upstanding peaks or projections separated by troughs. The projections are hexagonal in shape with substantially flat top surfaces and have a height in the range of about 0.625 inches. The core layer 114 had a thickness of 2 inches with cavity depth of 1 inch. The cavities 150 had circular cross-sectional shapes with a diameter of 1.75 inches. Four of the zones in the seven total zones had cavities in the core layer, with the cavity depth approximately equal in all four zones.

In Table 1, Sample A was a commercially available bedding mattress with a 6 inch thickness composed of three layers of foam. The first or top layer is a high resiliency polyether polyurethane foam with a thickness of about 2 inches and pin convolutions in the heel section, and two core layers are of conventional polyether polyurethane foam, each with a thickness of about 2 inches.

Sample B was a commercially available bedding mattress with a 6 inch thickness composed of two 3 inch wide side rails and a 30 inch wide center section. The center section is composed of two layers of polyurethane foam. The first or top layer is a viscoelastic polyurethane foam with a thickness of about 3 inches with a softer viscoelastic polyurethane foam in the heel section that slopes to the end of the mattress, and a core layer of conventional polyether polyurethane foam with a thickness of about 3 inches.

Sample C was a commercially available medical mattress with a single layer of a conventional polyether polyurethane foam with a thickness of about 6.5 inches.

Sample D was a commercially available medical mattress having four layers and a thickness of 7 inches. The first layer is composed of a high density polyether polyurethane foam with a contour cut surface and a thickness of about 2 inches that slopes down to the end of the heel section. The second layer is a conventional polyether polyurethane foam with a thickness of about 2 inches. The third and fourth layers are conventional polyether polyurethane foams with thicknesses of about 1.5 inches.

Sample E was a commercially available medical mattress that is formed as a single layer of a latex foam with a thickness of about 4 inches. A Pressure map generated for Sample E is shown in FIG. 8.

TABLE 1

| Mattress | Rating | Avg. Pressure | Max. Pressure | Avg. Area |
|---|---|---|---|---|
| Example 1 - 7 Zone | | 14.3 | 29.9 | 664 |
| Example 2 - 7 zone | | 18.1 | 33.9 | 447 |
| Sample A | 300 lbs. | 17.2 | 58.9 | 434 |
| Sample B | 500 lbs. | 16.0 | 45.5 | 451 |
| Sample C | 750 lbs. | 23.4 | 49.1 | 320 |
| Sample D | 750 lbs. | 18.9 | 46.9 | 374 |
| Sample E | | 20.2 | 50.8 | 370 |

The data in Table 1 was generated from pressure distribution maps using an XSensor PX100: 26.64.01 pressure mapping system. An adult female with a height of 5'3" and weighing 120 pounds reclined in the supine position on each mattress. The pressure resulting from supporting the reclining female was mapped for 3 minutes at a rate of 600 frames per minute. The average pressure for all frames was added and divided by the total number of frames. The peak pressure for all frames was added and divided by the total number of frames. The area for all frames was added and divided by the total number of frames. The average pressure, peak pressure, and area were reported.

A higher average area in Table 1, using the same test subject in all cases, indicates that the person's weight has been redistributed over a greater portion of the mattress. As such, the mattress better envelops the bony protrusions and better redistributes pressure over the person's body. Optimally, maximum pressure remains below the ischemic pressure threshold of 40 mmHg, which is demonstrated for Examples 1 and 2 according to the invention.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

We claim:

1. A mattress, comprising:

a first foam layer having a plurality of projections with substantially flat tops separated by gaps therebetween wherein the substantially flat tops define a top surface of said first foam layer, which top surface is a body-supporting surface of said mattress, said first foam layer further defining a bottom surface;

a second foam layer defining a length and a width and a thickness and having a continuous horizontal flat top surface extending completely along the length and the width and having a bottom surface and oriented with its top surface in contact with the bottom surface of the first foam layer, wherein said second foam layer defines at least two regions of the bottom surface from which foam material has been extracted to define multiple open cavities separated by inter-connected foam walls, and at least a portion of the multiple open cavities each define in cross-section a geometric shape selected from the group consisting of: circular, oval, hexagonal, octagonal, square, triangular and diamond, and said second foam layer defines at least one region across the width of the bottom surface from which foam material has not been extracted leaving said at least one region of the bottom surface substantially flat; and a third foam layer defining a top surface and a bottom surface and oriented with its top surface in contact with the bottom surface of the second foam layer.

2. The mattress of claim 1, wherein the first foam layer is joined to the second foam layer and the second foam layer is joined to the third foam layer to form a combination.

3. The mattress of claim 2, further comprising a ticking material or casing surrounding said combination.

4. The mattress of claim 1, wherein the first foam layer is formed of a viscoelastic foam having a density in the range of 1.5 pcf to 10 pcf.

5. The mattress of claim 4, wherein the viscoelastic foam of the first layer has an air permeability above 60 $ft^2/ft^3$/min.

6. The mattress of claim 1, wherein the second foam layer is formed of a polyurethane foam having a density in the range of 1.0 pcf to 6.0 pcf.

7. The mattress of claim 1, wherein the third foam layer is formed of a polyurethane foam having a density in the range of 1.0 pcf to 6.0 pcf.

8. The mattress of claim 1, wherein the second foam layer defines a thickness and the multiple open cavities have a depth of from about one-twelfth to six-sevenths of the thickness of the second foam layer.

9. The mattress of claim 1, wherein the second foam layer defines at least four regions in the bottom surface from which foam material has been extracted to define multiple open cavities separated by inter-connected foam walls.

10. The mattress of claim 1, wherein the multiple open cavities define a void volume that comprises from 4 to 51% of the volume of the second foam layer.

11. The mattress of claim 1, wherein the substantial portion of the multiple open cavities each define in cross section a first geometric shape and a second substantial portion of the multiple open cavities each define in cross section a second and different geometric shape.

12. The mattress of claim 1, wherein a substantial portion of the projections of the first foam layer each define in cross-section a geometric shape selected from the group consisting of: circular, oval, hexagonal, octagonal, square, triangular, and diamond.

13. In a mattress construction incorporating at least three layers of foams of varying density and thickness, characterized by a core foam layer disposed between a top foam layer and a bottom foam layer, said core foam layer having a substantially flat, uncut top surface and a bottom surface and oriented with its bottom surface away from a body-supporting surface of the mattress construction, wherein said core foam layer defines at least two spaced apart regions in the bottom surface from which foam material has been extracted to define multiple open cavities separated by inter-connected foam walls, wherein said open cavities each define in cross-section a geometric shape selected from the group consisting of: circular, oval, hexagonal, octagonal, square, triangular, and diamond, and wherein said open cavities extend partially through the thickness of the core foam layer.

14. The mattress construction of claim 13, wherein the substantial portion of the multiple open cavities each define in cross section a first geometric shape and a second substantial portion of the multiple open cavities each define in cross section a second and different geometric shape.

15. The mattress construction of claim 13, wherein the top surface of the core foam layer is joined to a bottom surface of the top foam layer, and the bottom surface of the core foam layer is joined to a top surface of the bottom foam layer.

16. The mattress construction of claim 13, wherein the top foam layer, core foam layer and bottom foam layer comprise the only foam layers in said mattress construction.

17. The mattress construction of claim 13, further comprising an outer ticking or casing material over at least a top surface of the top foam layer and a bottom surface of the bottom foam layer.

18. The mattress construction of claim 13, wherein the core foam layer defines at least four regions in the bottom surface from which foam material has been extracted to define multiple open cavities separated by inter-connected foam walls.

* * * * *